US011118761B1

(12) United States Patent
Bhovi et al.

(10) Patent No.: US 11,118,761 B1
(45) Date of Patent: Sep. 14, 2021

(54) LIGHTING STRUCTURE END CAP MOUNTS TO SECURE CABLE WITHOUT LEAKAGE PATHS

(71) Applicant: Universal Lighting Technologies, Inc., Madison, AL (US)

(72) Inventors: Arjun P. Bhovi, Madison, AL (US); Christopher Radzinski, Huntsville, AL (US); Theodore E. Kluska, Madison, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 0 days.

(21) Appl. No.: 16/902,833

(22) Filed: Jun. 16, 2020

Related U.S. Application Data

(60) Provisional application No. 62/890,706, filed on Aug. 23, 2019.

(51) Int. Cl.

| | |
|---|---|
| ***F21V 15/015*** | (2006.01) |
| ***F21V 23/00*** | (2015.01) |
| ***F21V 5/04*** | (2006.01) |
| ***F21V 19/00*** | (2006.01) |
| ***F21K 9/272*** | (2016.01) |

(52) U.S. Cl.
CPC ..... *F21V 15/015* (2013.01); *F21K 9/272* (2016.08); *F21V 5/043* (2013.01); *F21V 19/008* (2013.01); *F21V 23/002* (2013.01)

(58) Field of Classification Search
CPC ..... F21K 9/272; F21V 15/013; F21V 15/015; F21V 19/008
See application file for complete search history.

(56) References Cited

U.S. PATENT DOCUMENTS 10,690,335 B2 * 6/2020 Xue ..... F21V 31/005
10,851,986 B2 * 12/2020 Zhang ..... F21V 27/02

* cited by examiner

*Primary Examiner* — Matthew J. Peerce
(74) *Attorney, Agent, or Firm* — Patterson Intellectual Property Law, P.C.; Gary L. Montle; Jerry Turner Sewell

(57) ABSTRACT

An end cap mounting system for a lens of a lighting fixture includes a lens engagement portion having a proximal end, a distal end, an outer surface and an inner surface. The inner surface defines a cavity extending distally into the lens engagement portion from the proximal end for a cavity depth to a cavity end surface. The cavity has an inner wall with a perimeter corresponding to a first asymmetric shape of an outer profile of a lens. A central protrusion extends proximally from the cavity end surface towards the proximal end. The protrusion has an outer wall with a perimeter that corresponds to a second asymmetric shape of an inner profile of the lens. A gasket-receiving recess is positioned proximate to the cavity end surface between the outer wall of the central protrusion and the inner wall of the cavity to receive a gasket.

20 Claims, 12 Drawing Sheets

LIGHTING STRUCTURE END CAP MOUNTS TO SECURE CABLE WITHOUT LEAKAGE PATHS

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCE TO RELATED APPLICATION

This application claims the benefit under 35 USC. § 119(e) of U.S. Provisional Application No. 62/890,706, filed Aug. 23, 2019, entitled "End Cap Mounts to Secure Cable Without Leakage Paths," which is hereby incorporated by reference in its entirety.

FIELD OF THE INVENTION

The present disclosure relates generally to lighting systems and, more particularly, to apparatuses to prevent entry of contamination into a light system.

BACKGROUND

Compact low-power lighting systems are becoming more commonplace for residential and office lighting as the costs for lighting systems based on light-emitting diodes (LEDs) decrease. Because of the small size of LED-based lighting systems, the LED-based lighting systems are more noticeably affected by contamination such as contamination from dust and moisture. Although LED-based lighting systems generally produce less heat than corresponding lighting systems based on other technologies, LED based lighting systems do produce heat such that an increased volume of heated air surrounding the lighting systems must be allowed to escape. Thus, a completely sealed LED-based lighting system may not be feasible.

SUMMARY

A need exists for an LED-based lighting system that enables heated air surrounding an LED lighting source to escape while preventing entry of contaminants such as dust and moisture.

One aspect of the embodiments disclosed herein is an end cap mounting system for a lens of a lighting fixture. The end cap mounting system includes a lens engagement portion having a proximal end, a distal end, an outer surface and an inner surface. The inner surface defines a cavity extending distally into the lens engagement portion from the proximal end for a cavity depth to a cavity end surface. The cavity has an inner wall with a perimeter corresponding to a first asymmetric shape of an outer profile of a lens. A central protrusion extends proximally from the cavity end surface towards the proximal end. The protrusion has an outer wall with a perimeter that corresponds to a second asymmetric shape of an inner profile of the lens. A gasket-receiving recess is positioned proximate to the cavity end surface between the outer wall of the central protrusion and the inner wall of the cavity to receive a gasket.

Another aspect of the embodiments disclosed herein is an end cap mounting system for a lens of a lighting fixture in which the lens is elongated along a longitudinal axis. The lens has an outer surface having an outer profile along the longitudinal axis. The outer profile has a first asymmetric shape. The lens has a central bore along the longitudinal axis. The central bore forms an inner surface of the lens. The inner surface of the lens has an inner profile having a second asymmetric shape. The end cap mounting system comprises an end cap and an end cap mount. The end cap mount has a lens engagement portion and an end cap engagement portion. The end cap engagement portion extends distally from the lens engagement portion to engage the end cap. The lens engagement portion has a proximal end, a distal end, an outer surface and an inner surface. The inner surface defines a cavity extending distally into the lens engagement portion from the proximal end for a cavity depth to a cavity end surface. The cavity has an inner wall with a perimeter corresponding to the first asymmetric shape of the outer profile of the outer surface of the lens. A central protrusion extend\s proximally from the cavity end surface towards the proximal end of the lens engagement portion. The protrusion has an outer wall with a perimeter that corresponds to the second asymmetric shape of the inner profile of the inner surface of the lens. A first bore extends through the distal end of the lens engagement portion and through the central protrusion. A gasket-receiving recess is positioned proximate to the cavity end surface between the outer wall of the central protrusion and the inner wall of the cavity.

In certain embodiments in accordance with this aspect, a plurality of standoffs extend from the cavity end surface of the lens engagement portion. The standoffs are positioned between the outer wall of protrusion and the inner wall of the cavity. The gasket has openings to accommodate the plurality of standoffs.

In certain embodiments in accordance with this aspect, the end cap engagement portion of the end cap mount comprises an outer surface and a distal end surface. The outer surface supports a plurality of first engagement features protruding from the outer surface. The end cap engagement portion further comprises a central bore that extends through the end cap engagement portion and through the protrusion within the cavity. In certain embodiments, the end cap comprises a proximal portion and a distal portion. The proximal portion has an outer wall and an inner cavity. The inner cavity of the proximal portion of the end cap has an inner surface having a size selected to fit around the outer surface of the end cap engagement portion of the end cap mount. The outer wall of the proximal portion has a plurality of second engagement features. Each second engagement feature is positioned to engage one of the first engagement features of the end cap mount when the end cap is engaged with the end cap engagement portion of the end cap mount. In certain embodiments, each first engagement feature of the end cap mount comprises a protrusion extending radially outward from the outer surface of the distal end portion of the lens engagement portion; and each second engagement feature of the end cap comprises an opening through the outer wall of the proximal portion of the end cap, each opening aligned with a respective protrusion when the end cap is engaged with the lens engagement portion. In certain embodiments, a plurality of pairs of slits extend through the outer wall of the proximal portion of the end cap. Each pair of slits comprises a respective first slit and a respective second slit, wherein each slit extends to the proximal end of the outer wall, and wherein each second engagement feature is positioned between the respective first slit and the respective second slit in a respective pair of slits. Each pair of slits enables a respective portion of the outer wall between the respective first slit and the respective second slit in the pair to move outward away from the inner cavity of the end cap cover portion.

In certain embodiments, the end cap further comprises a distal portion. The distal portion has a distal end surface. The distal portion has a central bore that extends from the distal end surface to the inner cavity of the end cap. In certain embodiments, the distal portion of the end cap includes an outer wall surrounding the central bore, and a threaded bore extends radially inward through the outer wall to the central bore. In certain embodiments, a screw has external threads that engage the threaded bore of the end cap.

In certain embodiments, the end cap mounting system includes a cylindrical grommet having an outer diameter and having a central bore. The end cap engagement portion of the end cap mount includes a distal cavity. The distal cavity has a diameter sized to receive the cylindrical grommet and to position the cylindrical grommet within the central bore such that the cylindrical grommet is aligned with the central bore of the cap cover engagement portion.

In certain embodiments, the end cap mounting system further comprises a filter. The filter has an outer perimeter with a selected shape. The filter has a thickness. The end cap engagement portion of the end cap mount includes a distal recess having the selected shape and having a recess depth corresponding to the thickness of the filter. The filter is positioned in the recess. In certain embodiments, the filter comprises a microporous polytetrafluoroethylene (PTFE) membrane.

In certain embodiments, the end cap mounting system further comprises a gasket having a shape configured to fit into the gasket-receiving recess of the lens engagement portion. In certain embodiments, the gasket comprises a high viscosity adhesive that fills the gasket-receiving recess. In certain embodiments, the gasket comprises silicone rubber.

Another aspect of the embodiments disclosed herein is a lighting system. The lighting system comprises a lens holder having a longitudinally extending support surface. A first side wall and a second side wall extend from the support surface. Each side wall has a respective lens retention feature. A longitudinally extending lens is positionable within the lens holder. The lens has a first end and a second end. The lens has a first retention feature to engage the lens retention feature of the first side wall and a second retention feature to engage the lens retention feature of the second side wall. The lens further includes a printed circuit board receiving recess. A printed circuit board comprises a plurality of light-emitting diodes (LEDs). The printed circuit board is positioned in the printed circuit board receiving recess of the lens. A first end cap mounting assembly is positioned on the first end of the lens. The first end cap mounting assembly comprises a first lens cap mount. The first end cap mount comprises a first lens engagement portion having a first cavity surrounded by a first cavity wall. The first lens engagement portion receives a portion of the first end of the lens within the first cavity. The first lens engagement portion includes a first lens engagement portion central bore extending into the first cavity. A grommet is positioned within the first lens engagement portion central bore. The grommet has a grommet central bore. A first end cap engagement portion extends from the second lens engagement portion. A first end cap is positioned over a distal end of the first end cap engagement portion of the first end cap mount. The first end cap has a first end cap central bore aligned with the first lens engagement portion central bore. A second end cap mounting assembly is positioned on the second end of the lens. The second end cap mounting assembly comprises a second end cap mount. The second end cap mount comprises a second lens engagement portion having a second cavity surrounded by a second cavity wall. The second lens engagement portion receives a portion of the second end of the lens within the second cavity. The second lens engagement portion includes a second lens engagement portion central bore extending into the second cavity. A filter is positioned over the second lens engagement portion central bore. A second end cap engagement portion extends from the second lens engagement portion. A second end cap is positioned over the second end cap engagement portion of the second end cap mount. The second end cap has a second end cap central bore aligned with the central bore of the first end cap mount. An electrical cable is positioned through the first end cap central bore, through the grommet central bore and through the first lens engagement portion central bore. The electrical cable has at least first and second conductors engaged with the printed circuit board.

In certain embodiments in accordance with this aspect, the first end cap and the second end cap are identical.

In certain embodiments in accordance with this aspect, a first gasket is positioned within the first cavity of the first lens engagement portion with the first gasket positioned against the first end of the lens. A second gasket is positioned within the second cavity of the second lens engagement portion with the second gasket positioned against the second end of the lens.

In certain embodiments in accordance with this aspect, a portion of the first cavity wall of the first lens engagement portion has a first peripheral opening positioned to enable light from a portion of the first end portion of the lens to pass through the first peripheral opening; and a portion of the second cavity wall of the second lens engagement portion has a second peripheral opening positioned to enable light from a portion of the second end portion of the lens to pass through the second peripheral opening.

In certain embodiments in accordance with this aspect, the lens has an outer surface having an outer asymmetric profile and has an inner surface having an inner asymmetric profile. The first cavity of the first lens engagement portion has an inner surface with an inner profile matching the outer asymmetric profile of the lens. A first protrusion extends proximally within the first cavity. The first protrusion has an outer surface with an outer profile matching the inner asymmetric profile of the lens. The second cavity of the second lens engagement portion has an inner surface with an inner profile matching the outer asymmetric profile of the lens. A second protrusion extends proximally within the second cavity. The second protrusion has an outer surface with an outer profile matching the inner asymmetric profile of the lens. When viewed from the respective proximal ends of the first lens engagement portion and the second lens engagement portion, the inner profile of the first cavity and the inner profile of the second cavity are mirror images of each other, and the outer profile of the first protrusion and the outer profile of the second protrusion are mirror images of each other.

BRIEF DESCRIPTIONS OF THE SEVERAL VIEWS OF THE DRAWINGS

DETAILED DESCRIPTION

The following detailed description of embodiments of the present disclosure refers to one or more drawings. Each drawing is provided by way of explanation of the present disclosure and is not a limitation. Those skilled in the art will understand that various modifications and variations can be made to the teachings of the present disclosure without departing from the scope of the disclosure. For instance, features illustrated or described as part of one embodiment can be used with another embodiment to yield a still further embodiment.

The present disclosure is intended to cover such modifications and variations as come within the scope of the appended claims and their equivalents. Other objects, features, and aspects of the present disclosure are disclosed in the following detailed description. One of ordinary skill in the art will understand that the present discussion is a description of exemplary embodiments only and is not intended as limiting the broader aspects of the present disclosure.

Figure 1:
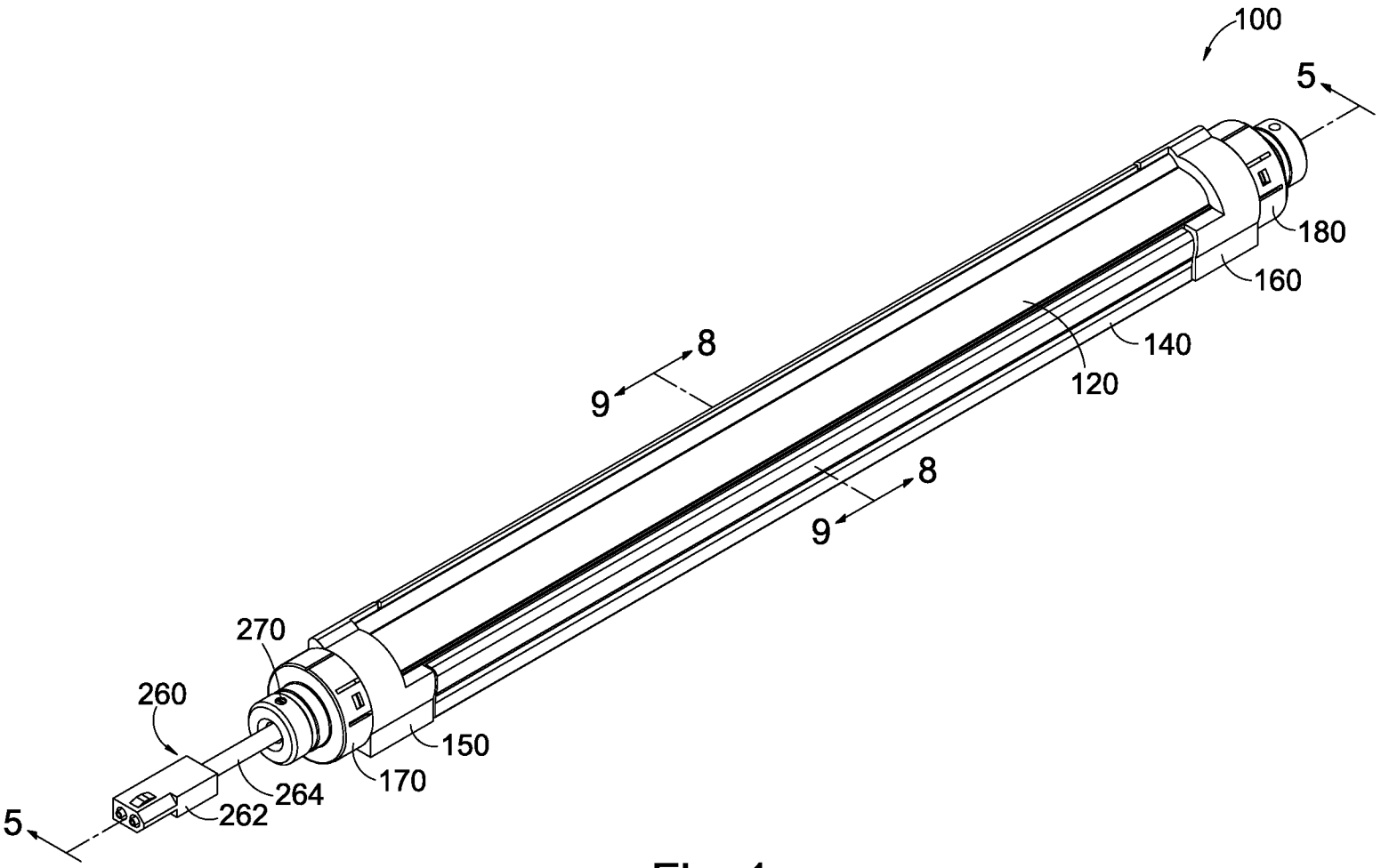
FIG. 1 illustrates a perspective view of a lighting structure viewed from a first end of the lighting structure.
Figure 2:
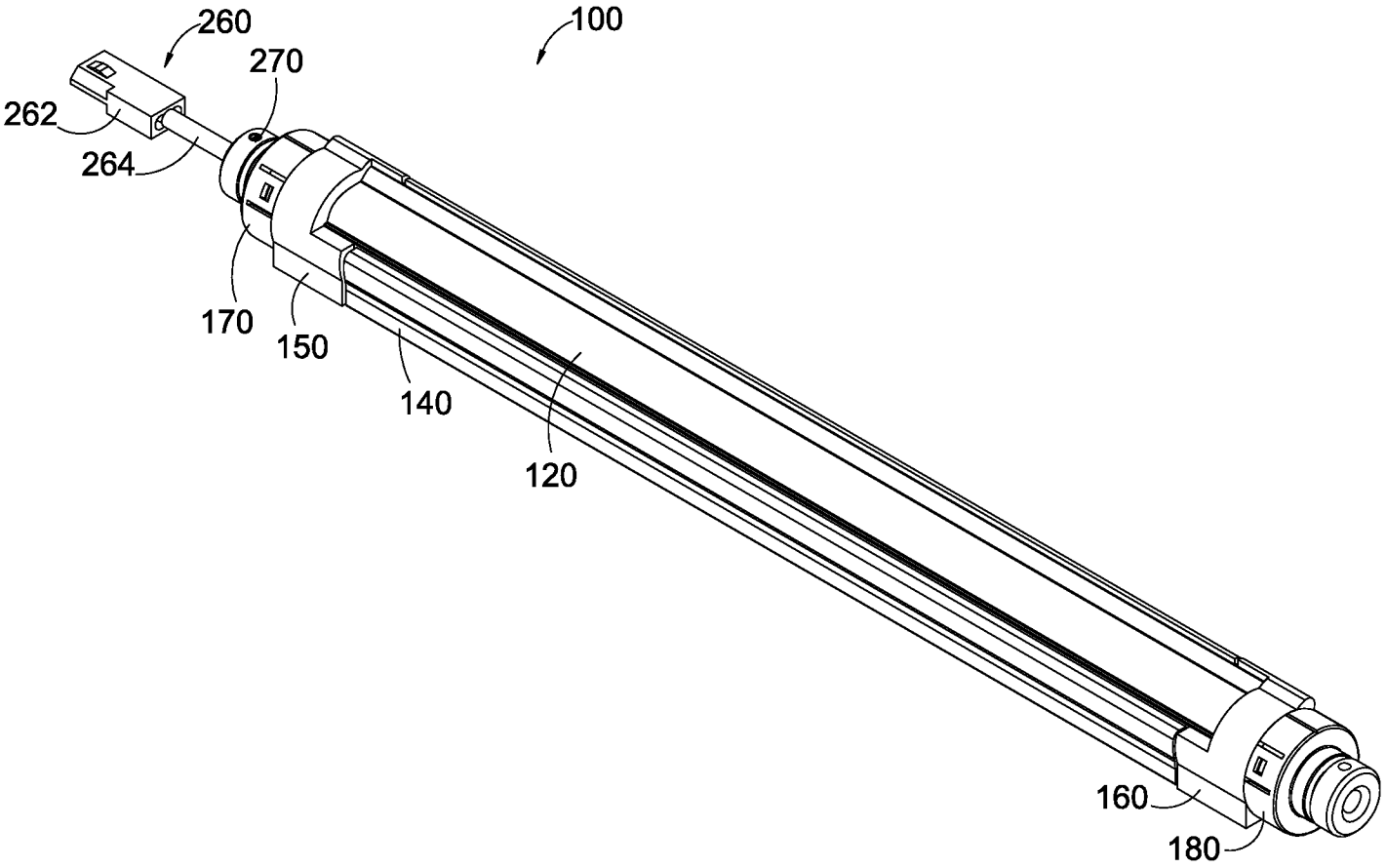
FIG. 2 illustrates a perspective view of the lighting structure of FIG. 1 viewed from a second end of the lighting structure.
Figure 3:
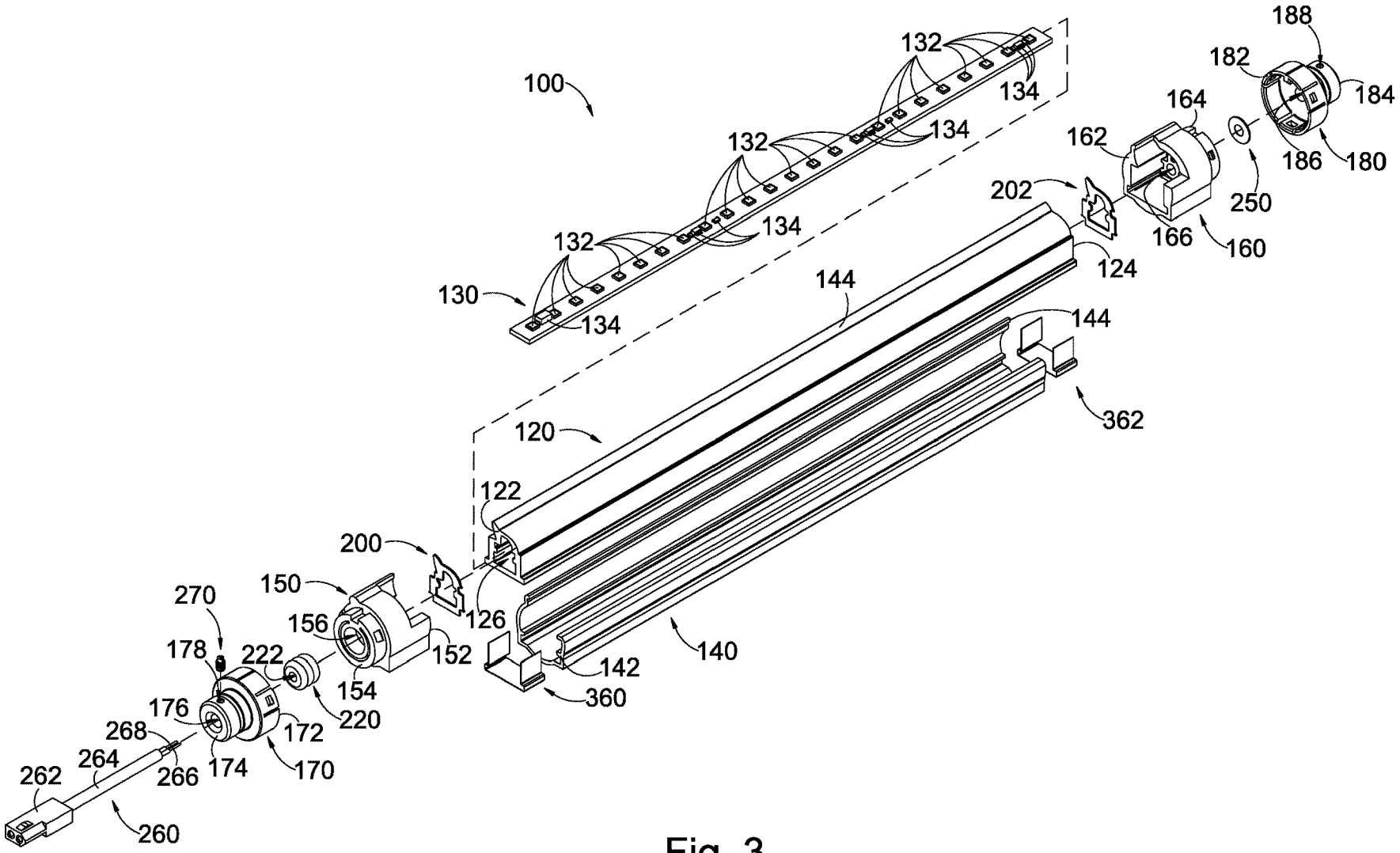
FIG. 3 illustrates an exploded perspective view of the lighting structure of FIG. 1 as viewed in FIG. 1.
Figure 4:
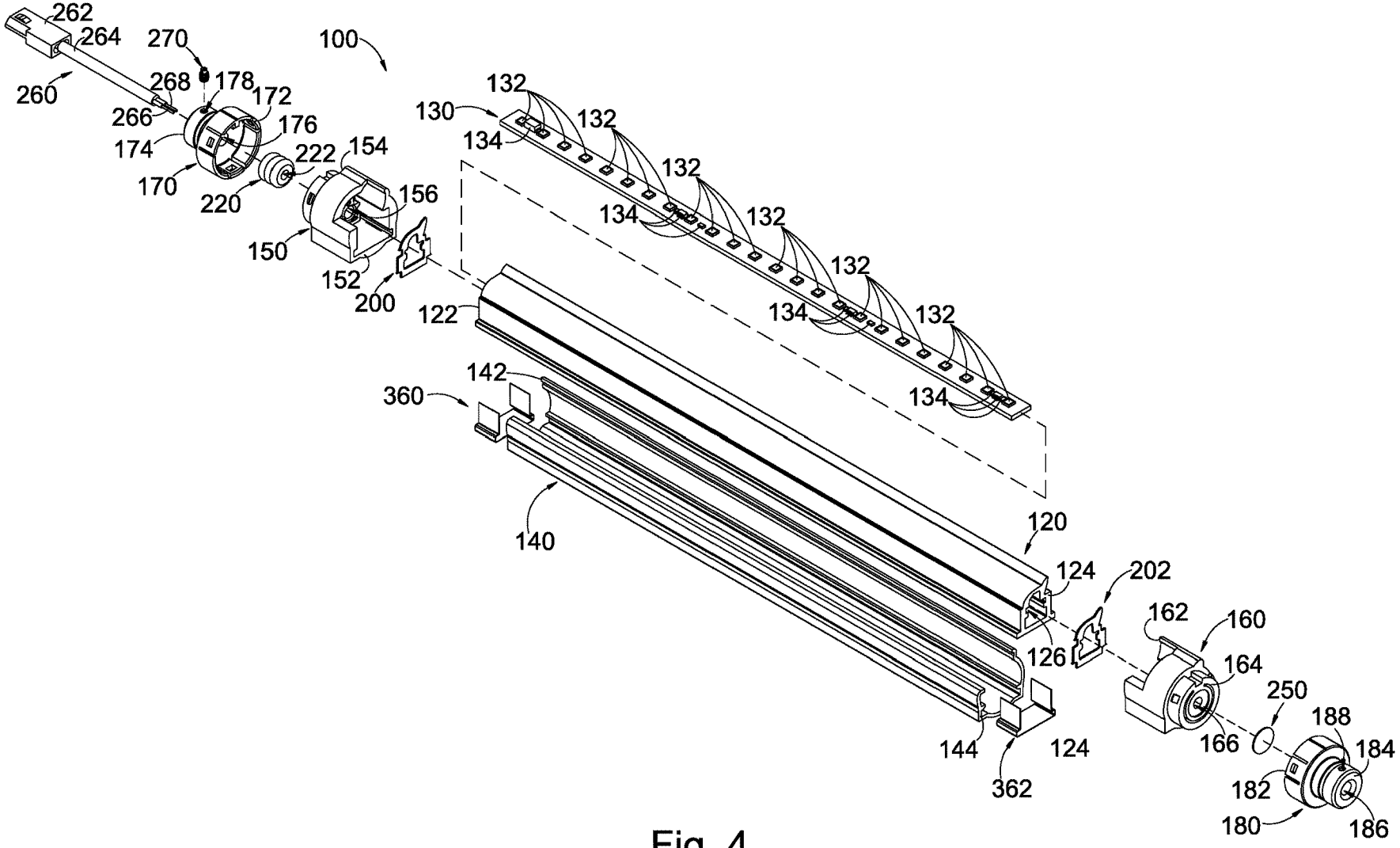
FIG. 4 illustrates an exploded perspective view of the lighting structure of FIG. 2 as viewed in FIG. 2.
Figure 5:
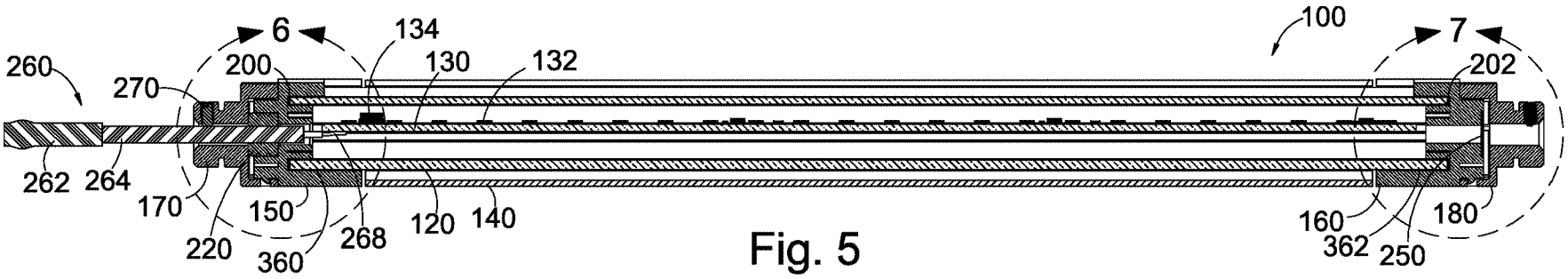
FIG. 5 illustrates a cross-sectional elevation view of the lighting structure of FIG. 1 taken along the line 5-5 in FIG. 1.
Figure 7:
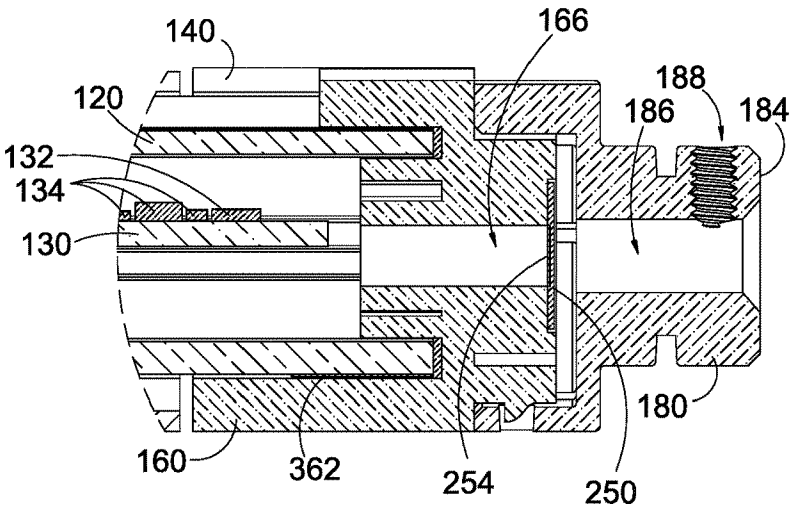
FIG. 7 illustrates an enlarged cross-sectional view of the lighting structure of FIG. 1 taken within the area —7—in FIG. 5.
Figure 6:
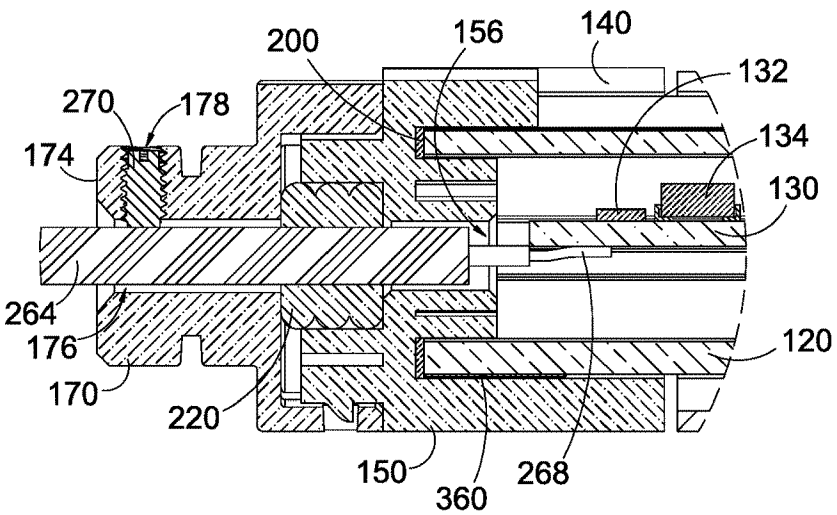
FIG. 6 illustrates an enlarged cross-sectional view of the lighting structure of FIG. 1 taken within the area —6—in FIG. 5.
Figure 8:
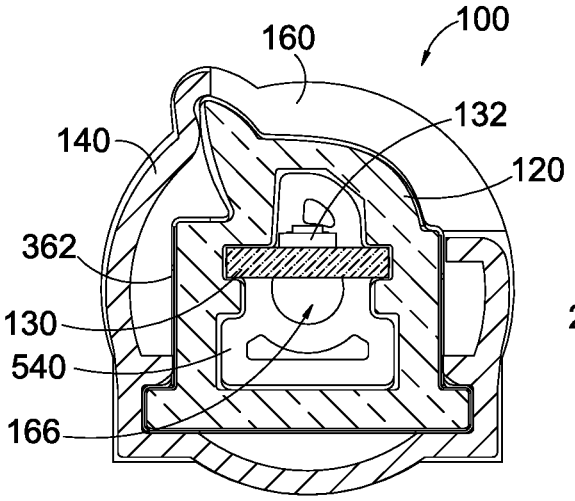
FIG. 8 illustrates a cross-sectional elevation view of the lighting structure of FIG. 1 taken along the line 8-8 in FIG. 1.
Figure 9:
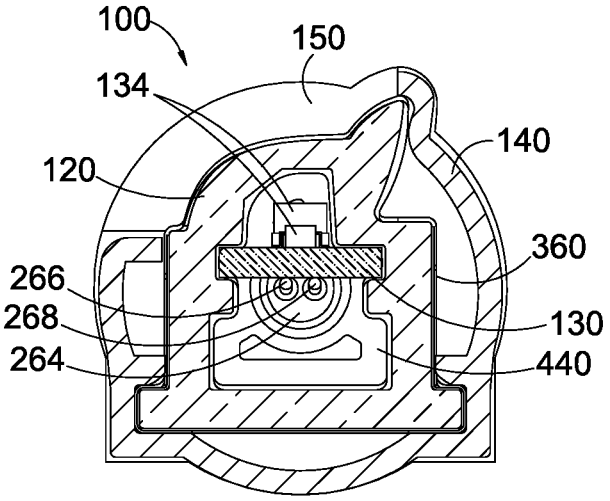
FIG. 9 illustrates a cross-sectional elevation view of the lighting structure of FIG. 1 taken along the line 9-9 in FIG. 1.

FIG. 1 illustrates a perspective view of an LED-based lighting structure 100 as viewed from a wiring end of the lighting structure. FIG. 2 illustrates a rotated perspective view of the lighting structure of FIG. 2 as viewed from a vented end of the lighting structure. FIG. 3 illustrates an exploded perspective view of the lighting structure of FIG. 1 showing the components of the lighting structure. FIG. 4 illustrates a rotated exploded view of the lighting structure. FIG. 5 illustrates a cross-sectional view taken along the line 5-5 in FIG. 1. FIG. 6 illustrates an enlarged cross-sectional view within the area —6—in FIG. 5. FIG. 7 illustrates an enlarged cross-sectional view within the area —7—in FIG. 5. FIG. 8 illustrates a cross-sectional view taken along the line 8-8 in FIG. 1. FIG. 9 illustrates a cross-sectional view taken along the line 9-8 in FIG. 1.

The lighting structure 100 includes a longitudinally disposed lens 120 having a first (left) end 122 and a second (right) end 124. The lens includes a cavity 126 that extends longitudinally through the lens from the first end to the second end. As used herein "left," "right," "top," "bottom," "upper," "lower" and like positional adjectives refer to the positioning of elements in the drawing figures and are not intended to suggest any positioning of the elements in an actual embodiment. For example, a physical lighting structure may be rotated to any position and operate as described herein.

The cavity 126 of the lens 120 receives and encloses a printed circuit board (PCB) 130. The PCB supports a plurality of light-emitting diodes (LEDs) 132 and supporting electronic components 134.

A longitudinally disposed mounting bracket (or rail) 140 is positioned on the lens 120. The mounting bracket has a first end 142 and a second end 144.

A first (left) end cap mount 150 is mounted on a portion of the lens 120 near the first end 122 of the lens. The first end cap mount has a proximal end 152 and a distal end 154. A through bore 156 extends through the first end cap mount.

A second (right) end cap mount 160 is mounted on a portion of the lens near the second end of the lens. The second end cap mount has a proximal end 162 and a distal end 164. A through bore 166 extends through the second end cap mount.

As used herein, "proximal end" refers to the end of the respective end cap mount 150, 160 nearer the lens 120, and "distal end" refers to the end of the respective end cap mount facing away from the lens. Accordingly, the proximal ends of the two end cap mounts face towards each other.

A first (left) end cap 170 is mounted on the first end cap mount 150. A proximal end 172 of the first end cap faces toward the first end cap mount and engages the first end cap mount. A distal end 174 of the first end cap faces away from the first end cap mount. The first end cap includes a central through bore 176 that extends longitudinally through the first end cap. When assembled as shown in FIGS. 1 and 2, the through bore of the first end cap is aligned with the through bore 156 of the first end cap mount 150. The distal end of the first end cap includes a threaded bore 178 that extends axially inward from the outer surface of the distal end to the longitudinal through bore.

A second (right) end cap 180 is mounted on the second end cap mount 160. A proximal end 182 of the second end cap faces toward the second end cap mount and engages the second end cap mount. A distal end 184 of the second end cap faces away from the second end cap mount. The second end cap includes a central through bore 186 that extends longitudinally through the first end cap. When assembled as shown in FIGS. 1 and 2, the through bore of the second end cap is aligned with the through bore 166 of the second end cap mount 160. The distal end of the first end cap includes a threaded bore 188 that extends axially inward from the outer surface of the distal end to the longitudinal through bore.

As shown in FIGS. 3 and 4, a first (left) sealing gasket 200 is positioned against the first end 122 of the lens 120. A second (right) sealing gasket 202 is positioned against the second end 124 of the lens. In the illustrated embodiment, each sealing gasket comprises a silicone adhesive such as Dow Corning Dowsil™ SE 9186 clear silicone adhesive, which is commercially available from the Dow Chemical Company of Midland, Mich. The gaskets are described in more detail below.

Figure 32:
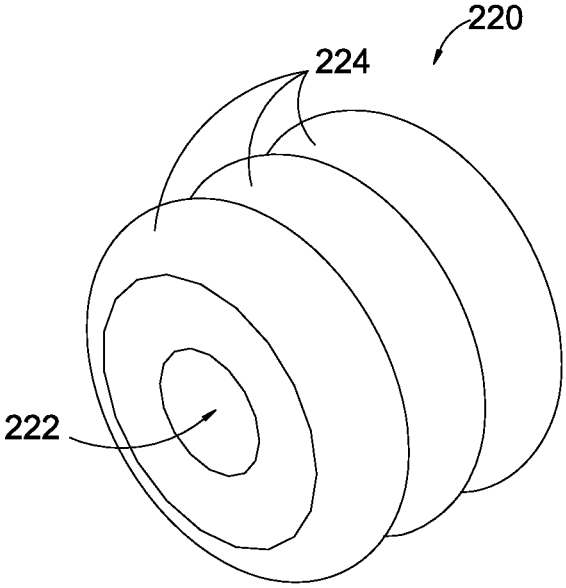
FIG. 32 illustrates a perspective view of the cable sealing grommet of the lighting structure of FIG. 1.

As shown in FIGS. 3 and 4, the first end cap mount 150 receives a cable-sealing grommet 220 (shown in enlarged detail in FIG. 32). In the illustrated embodiment, the grommet comprises a moldable silicone rubber material such as Dow Corning Xiameter™ RBB-6630 silicone rubber having a hardness of 30±5 durometer, which is commercially available from the Dow Chemical Company of Midland, Mich. In the illustrated embodiment, the grommet has an uncompressed length of approximately 0.3 inch and an uncompressed outer diameter of approximately 0.19 inch. A through bore 222 extends longitudinally through the cable-sealing grommet. In the illustrated embodiment, the through bore has a diameter of approximately 0.13 inch. The outer surface of the cable-sealing grommet has a plurality of ribs 224 (FIG. 32) to enable the grommet to be compressed when inserted into the first end cap mount. When the grommet is inserted into the first end cap mount and the first end cap 170 is attached to the first end cap mount, the grommet is compressed to a length of approximately 0.25 inch as shown in FIG. 6. As further shown in FIG. 6, the through bore of the grommet is aligned with the through bore 156 of the first end cap mount and the through bore 176 of the first end cap 170.

Figure 30:
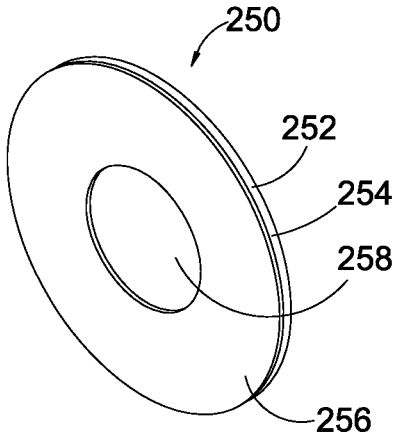
FIG. 30 illustrates a perspective view of the proximal side of the filter of the lighting structure of FIG. 1.
Figure 31:
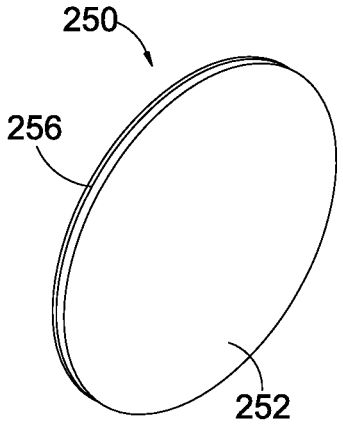
FIG. 31 illustrates a perspective view of the distal side of the filter of FIG. 30.

As shown in FIGS. 3, 4, 30 and 31, the second end cap mount 160 receives a filter 250. In the illustrated embodiment, the filter comprises a POREX® polytetrafluoroethylene (PTFE) protection vent, which is commercially available from Porex Corporation of Fairburn, Ga. In the illustrated embodiment, the filter comprises a layer 252 of filter material having an outer diameter of approximately 0.36 inch and a thickness of approximately 180 microns. As shown in FIG. 30, an outer portion 254 of one surface of the filter is covered with an adhesive such as an annular segment of double-coated tape 256. A central inner portion 258 of the surface has a diameter of approximately 0.18 inch and is not coated with adhesive such that air flows freely through the inner portion. The filter allows air to flow through the central inner portion; however, moisture and other contaminants cannot pass through the filter. The release liner of the double-sided tape is removable so that the filter can be adhered to the second end cap mount.

A wiring assembly 260 includes a connector 262 and a two-wire cable 264. A portion of the two-wire cable extends through the central through bore 176 of the first end cap 170, extends through the through bore 222 of the cable-sealing grommet 220 and extends through the through bore 156 of the first end cap mount 150. The two-wire cable extends into the cavity 126 of the lens 120. A first conductor 266 and a second conductor 268 of the two-wire cable are electrically connected to the PCB 130 to provide power to the LEDs 132 on the PCB. The two-wire cable is secured within the through bore of the first end cap by a set screw 270, which is threaded into the axial bore 178 of the first end cap.

Figure 10:
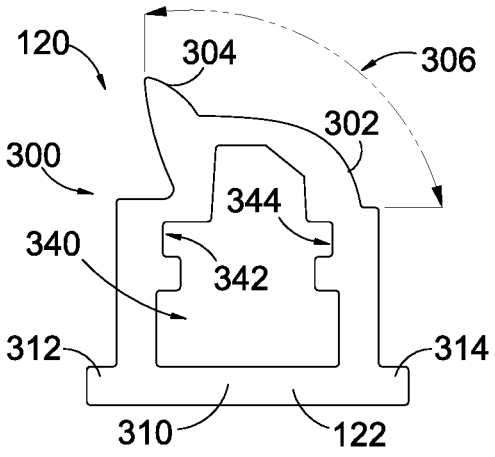
FIG. 10 illustrates an elevational view of the first (left) end of the lens of the lighting structure of FIG. 1.

As shown in FIGS. 8, 9 and 10, the lens 120 has an asymmetric outer profile 300 to control the emission of light emitted from the LEDs 132 (one shown in FIGS. 8 and 9). The outer profile of the lens includes a curved emission surface 302 and a protruding emission structure 304. The light from the emission surface and the emission structure redirect the light over a selected emission range 306.

The lens 120 includes a base portion 310 opposite the emission surface 302 and the emission structure 304. A first mounting ledge 312 and a second mounting ledge 314 extend from the base portion. As shown in FIGS. 8 and 9, the first mounting ledge engages a first mounting recess 320 of the mounting bracket 140. The second mounting ledge engages a second mounting recess 322 of the mounting bracket.

Figure 11:
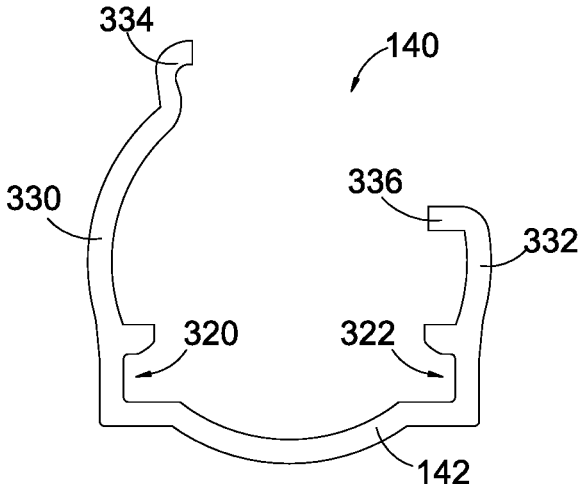
FIG. 11 illustrates an elevational view of the first (left) end of the mounting bracket of the lighting structure of FIG. 1.

As shown in FIGS. 8, 9 and 11, the mounting bracket 140 further includes a first (rear) wall 330 and a second (front) wall 332. The second wall is shorter than the first wall. The first wall includes an upper extended L-shaped portion 334 that engages a rear portion of the emission structure 304 of the lens 120 to block light emission rearwardly from the lens. The second wall includes an inwardly extending portion 336 that engages the lens. In the illustrated embodiment, the mounting bracket comprises an extruded material such as plastic or metal. The extruded material is resilient such that when the lens is inserted into the bracket, the two portions of the first and second walls of the bracket exert sufficient pressure against the lens to retain the lens in place within the mounting bracket As further shown in FIGS. 8, 9 and 10, the lens 120 has an asymmetric inner profile 340. The inner profile defines a first PCB-receiving recess 342 and a second PCB-receiving recess 344. The PCB 130 slides into the recesses and is supported such that the emission surfaces of the LEDs 132 face the emission surface 302 of the lens.

Figure 12:
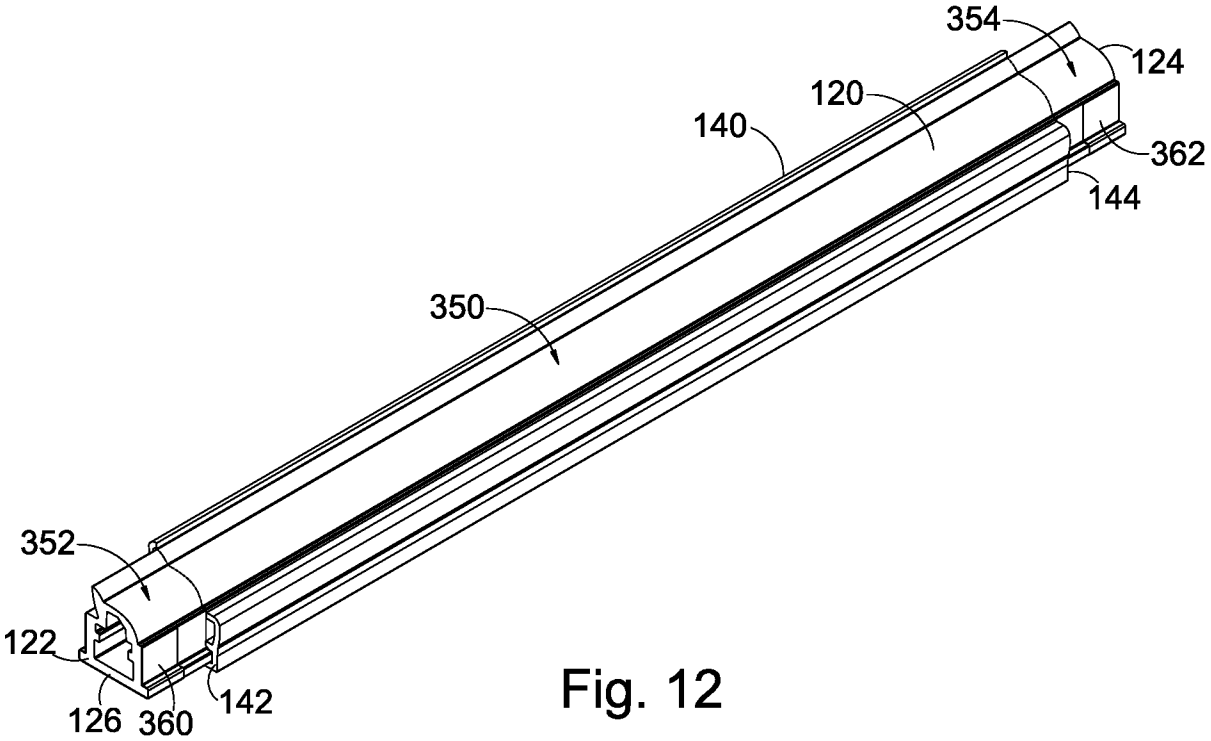
FIG. 12 illustrates a perspective view of the lens and the mounting bracket of the lighting structure of FIG. 1 showing the first and second end portions of the lens, and further showing the first and second strips of adhesive transfer tape on the first and second end portions of the lens.
Figure 13:
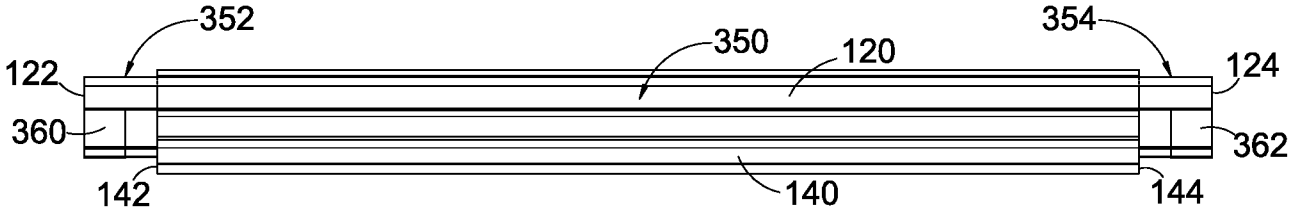
FIG. 13 illustrates an elevational view of the lens the mounting bracket of FIG. 12.

As shown in FIGS. 12 and 13, the mounting bracket 140 has a length that is shorter than a length of the lens 120 such that when the mounting bracket is positioned on the lens, the mounting bracket engages a middle portion 350 of the lens.

A first end portion 352 of the lens (delineated by dashed lines) extends beyond the first end 142 of the mounting bracket to the first end 122 of the lens. A second end portion 354 of the lens extends beyond the second end 144 of the mounting bracket to the second end 124 of the lens.

As further shown in FIGS. 12 and 13, a first strip 360 of adhesive transfer tape is attached to approximately one-half of the first end portion 352 of the lens 120 nearest the first end 122 of the lens. A second strip 362 of adhesive transfer tape is attached to approximately one-half of the second end portion 354 of the lens nearest the second end 124 of the lens. In the exploded views of FIGS. 3 and 4, the strips of adhesive transfer tape are illustrated with the shaped formed when the strips are pressed onto the end portions of the lens. The adhesive transfer tape comprises a pressure sensitive adhesive that sticks to the surfaces of the lens. The adhesive transfer tape further includes a release liner that is removed as described below. One example of a suitable adhesive transfer tape is 3M-368MP, which is commercially available from 3M of St. Paul, Minn.

The first cap mount 150 is shown in more detail in FIGS. 14-17. The first end cap mount includes a proximal lens engagement portion 400, which is positioned over the first end portion 352 (FIGS. 12-13) of the lens 120. The first end cap mount includes a distal end cap mounting portion 402, which extends outward distally from the engagement portion. As indicated above, "proximal" refers to a portion of first end mount nearer to the first end 122 of the lens, and "distal" refers to the portion of the first end cap mount farther from the first end of the lens.

The distal portion of the first end cap mount 150 includes a grommet-receiving recess 410 that receives the cable-sealing grommet 220 as shown in the cross-sectional view of FIG. 6. The grommet-receiving recess has an inner diameter of approximately 0.36 inch and a depth of approximately 0.2 inch.

The proximal lens engagement portion 400 of the first end cap mount 150 has an inner cavity 420 defined by a profile that has a size and shape generally corresponding to the outer profile 300 of the lens 120 as shown in FIG. 10. For example, the inner cavity includes a first recess 422 and a second recess 424 that receive the first mounting ledge 312 and the second mounting ledge 314, respectively, of the base portion 310 of the lens 120. The size of the inner cavity is selected so that the proximal lens engagement portion of the first end cap mount fits onto the first end portion 352 of the lens and over the first strip 360 of adhesive transfer tape. Prior to inserting the first end cap mount over the first strip of adhesive transfer tape, the release liner is removed from the tape. When the first end cap mount is positioned correctly, pressure is applied to the outer surfaces of the first end cap mount to cause the adhesive transfer tape to adhere to the surfaces of the inner cavity to secure the first end cap mount to the first end portion of the lens.

Figure 14:
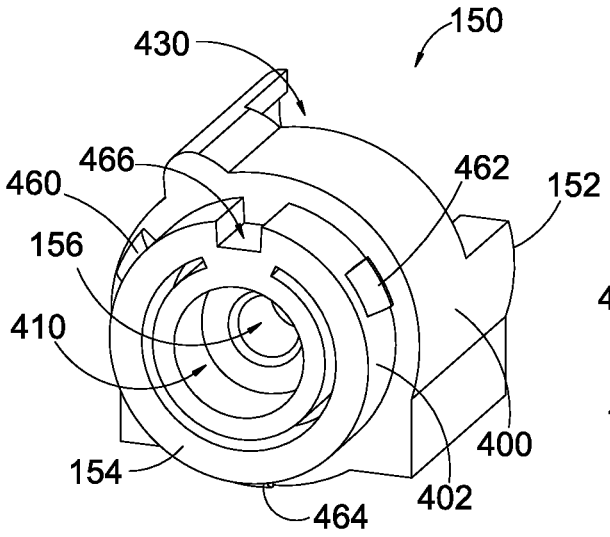
FIG. 14 illustrates a perspective view of the distal portion of the first (left) end cap mount of the lighting structure of FIG. 1.
Figure 15:
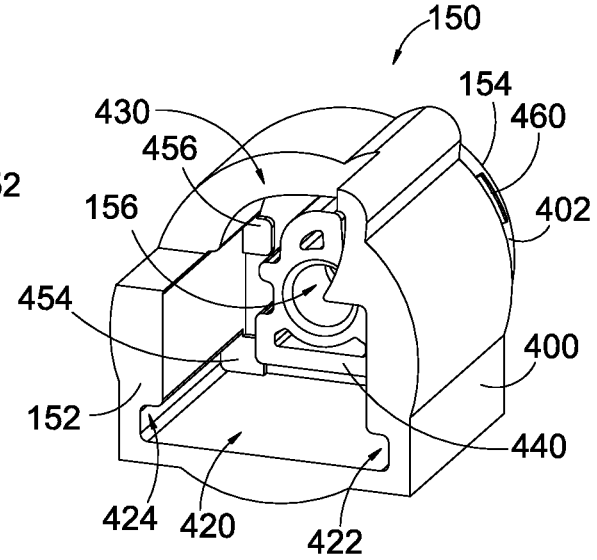
FIG. 15 illustrates a perspective view of the proximal portion of the first end cap mount of FIG. 14.
Figure 16:
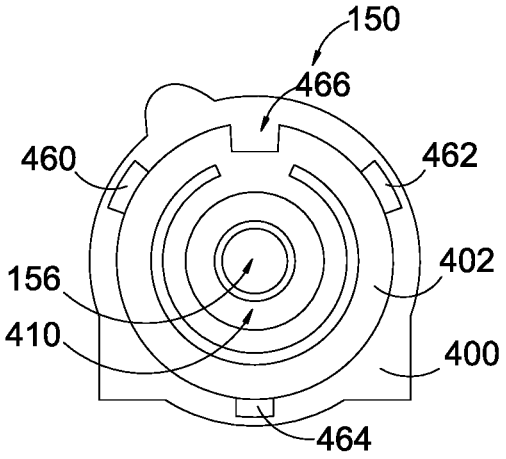
FIG. 16 illustrates an elevational view of the distal end of the first end cap mount of FIG. 14.

As shown in FIGS. 14 and 15, the proximal lens engagement portion 400 of the first end cap mount 150 includes a proximal cutout portion 430 that exposes portions of the curved emission surface 302 and the protruding emission structure 304 of first end portion 352 of the lens 120 that would otherwise be covered by the lens engagement portion.

Figure 17:
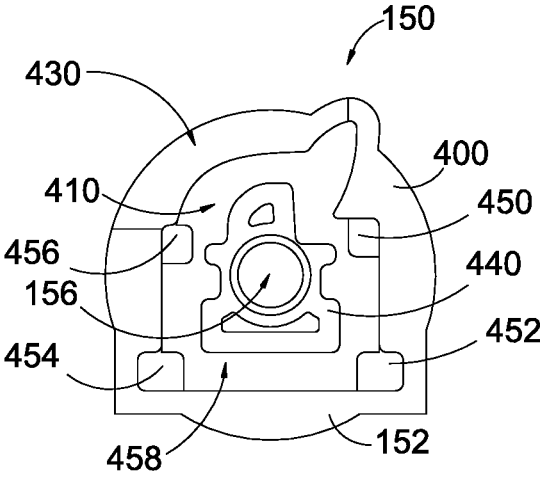
FIG. 17 illustrates an elevational view of the proximal end of the first end cap mount of FIG. 14.

As further shown in FIGS. 15 and 17, the first end cap mount 150 includes a central protrusion 440 that extends proximally into the inner cavity 420 for approximately 0.2 inch. The central protrusion has an outer profile that corresponds to the inner profile 340 of the lens 120 as shown in FIG. 10. When the first end cap mount is inserted over the first end portion 352 of the lens, the central protrusion extends into the cavity 126 of the lens to assist in positioning the lens within the first end cap mount.

As further shown in FIGS. 15 and 17, the first end cap mount 150 further includes a first lens standoff pad 450, a second lens standoff pad 452, a third lens standoff pad 454 and a fourth lens standoff pad 456 positioned within the inner cavity 420. The standoff pads are spaced apart from the central protrusion 440. The standoff pads extend into the inner cavity for a distance of approximately 0.02 inch. A gasket-receiving recess 458 is formed between the central protrusion and the standoff pads.

The first gasket sealing gasket 200 is formed by filling the gasket-receiving recess 458 with the silicone adhesive such as Dow Corning Dowsil™ SE 9186 clear silicone adhesive, which is commercially available from the Dow Chemical Company of Midland, Mich. The silicone adhesive is inserted into the recess as a high viscosity liquid and cures to form a permanent gasket. The four lens standoff pads 450, 452, 454, 456 assist in defining the shape of the gasket. The four lens standoff pads also prevent the gasket from being compressed too far when the first end cap mount 150 is inserted over the first end portion 352 of the lens 120 so that the gasket maintains a minimum thickness of approximately 0.02 inch.

As further shown in FIGS. 14-17, the first end cap mount 150 includes a first engagement protrusion 460, a second engagement protrusion 462 and a third engagement protrusion 464 that extend radially outward from the distal end cap mounting portion 402. In the illustrated embodiment, the three engagement protrusions are spaced approximately 120 degrees apart with the third engagement protrusion positioned at the bottom of the distal end cap mounting portion. The distal end cap mounting portion further includes an alignment slot 466 that extends radially inward at a position on the top of the distal end cap mounting portion between the first engagement protrusion and the second engagement protrusion. In the illustrated embodiment, the alignment slot is diametrically opposite the third engagement protrusion. In the illustrated embodiment, each engagement protrusion has a triangular profile with a ramp extending distally and with a flat portion facing proximally toward the proximal lens engagement portion 400.

The second cap mount 160 is shown in more detail in FIGS. 18-21. The second end cap mount includes a proximal lens engagement portion 500, which is positioned over the second end portion 354 (FIGS. 12-13) of the lens 120. The second end cap mount includes a distal end cap mounting portion 502, which extends outward distally from the engagement portion. As indicated above, "proximal" refers to a portion of second end mount nearer to the second end 124 of the lens, and "distal" refers to the portion of the second end cap mount farther from the second end of the lens.

The distal portion of the second end cap mount 160 includes a filter-receiving recess 510 that receives the filter 250 as shown in the cross-sectional view of FIG. 7. The filter-receiving recess has an inner diameter of approximately 0.38 inch and a depth of approximately 0.02 inch.

The proximal lens engagement portion 500 of the second end cap mount 160 has an inner cavity 520 defined by a profile that has a size and shape generally corresponding to the outer profile 300 of the lens 120 as shown in FIG. 10. The inner cavity of the second end cap mount is the mirror image of the inner cavity 420 of the first end cap mount 150. The inner cavity of the second end cap mount includes a first recess 522 and a second recess 524 that receive the first mounting ledge 312 and the second mounting ledge 314, respectively, of the base portion 310 of the lens 120. The size of the inner cavity is selected so that the proximal lens engagement portion of the first end cap mount fits onto the second end portion 354 of the lens and over the second strip 362 of adhesive transfer tape. Prior to inserting the second end cap mount over the second strip of adhesive transfer tape, the release liner is removed from the tape. When the second end cap mount is positioned correctly, pressure is applied to the outer surfaces of the second end cap mount to cause the adhesive transfer tape to adhere to the surfaces of the inner cavity to secure the second end cap mount to the second end portion of the lens.

Figure 18:
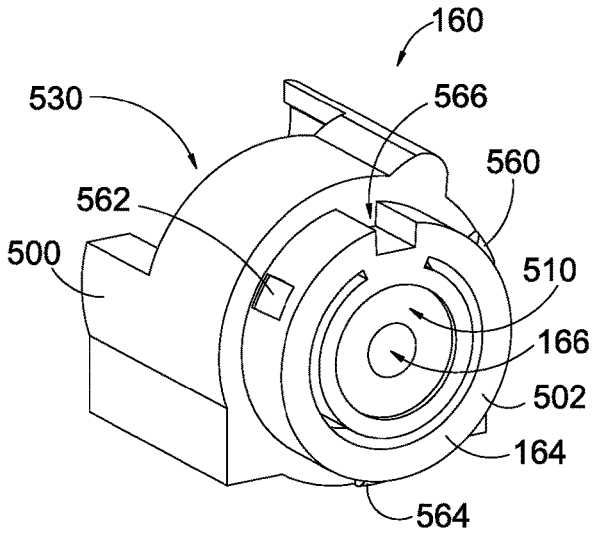
FIG. 18 illustrates a perspective view of the distal portion of the second (right) end cap mount of the lighting structure of FIG. 1.
Figure 19:
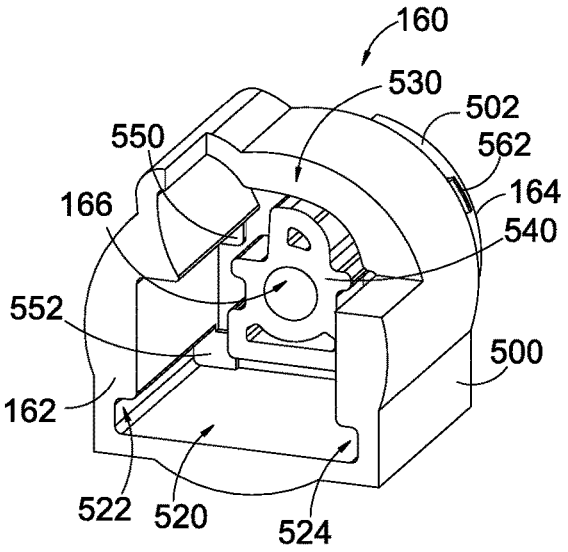
FIG. 19 illustrates a perspective view of the proximal portion of the second end cap mount of FIG. 18.
Figure 20:
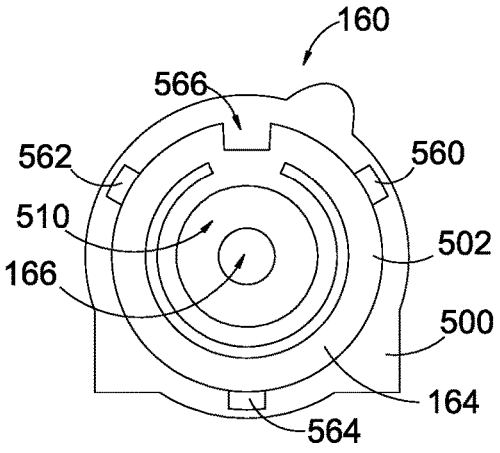
FIG. 20 illustrates an elevational view of the distal end of the second end cap mount of FIG. 18.

As shown in FIGS. 18 and 19, the lens engagement portion 500 of the second lens mount 160 includes a proximal cutout portion 530 that exposes portions of the curved emission surface 302 and the protruding emission structure 304 of the second end portion 354 of the lens 120 that would otherwise be covered by the lens engagement portion.

Figure 21:
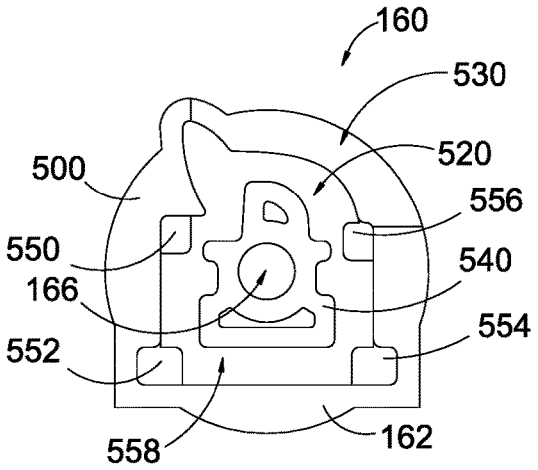
FIG. 21 illustrates an elevational view of the proximal end of the second end cap mount of FIG. 18.
Figure 22:
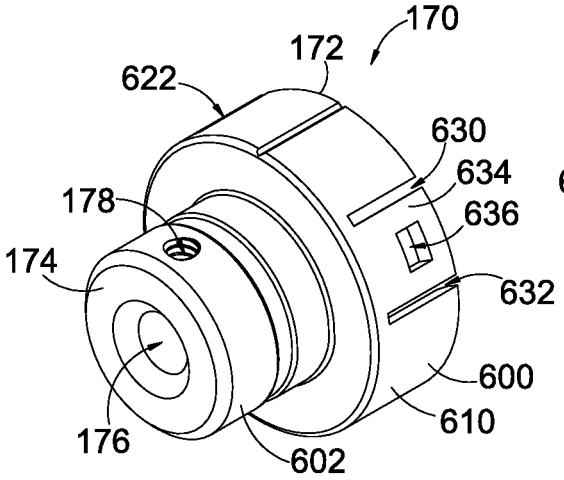
FIG. 22 illustrates a perspective view of the distal portion of the first (right) end cap of the lighting structure of FIG. 1.

As further shown in FIGS. 19 and 21, the second end cap mount 160 includes a central protrusion 540 that extends proximally into the inner cavity 520 for approximately 0.2 inch. The central protrusion has an outer profile that corresponds to the inner profile 340 of the lens 120 as shown in FIG. 10. The outer profile of the central protrusion of the second end cap mount is the mirror image of the outer profile of the central protrusion 440 of the first end cap mount 160. When the second end cap mount is inserted over the second end portion 354 of the lens, the central protrusion extends into the cavity 126 of the lens to assist in positioning the lens within the second end cap mount.

As further shown in FIGS. 19 and 21, the second end cap mount 160 further includes a first lens standoff pad 550, a second lens standoff pad 552, a third lens standoff pad 554 and a fourth lens standoff pad 556 positioned within the inner cavity 520. The standoff pads are spaced apart from the central protrusion 540. The standoff pads extend into the inner cavity for a distance of approximately 0.02 inch. A gasket-receiving recess 558 is formed between the central protrusion and the standoff pads.

The second gasket sealing gasket 202 is formed by filling the gasket-receiving recess 558 with the silicone adhesive, as described above. The silicone adhesive cures to form a permanent gasket. The four lens standoff pads 550, 552, 554, 556 assist in defining the shape of the gasket. The standoff pads also prevent the gasket from being compressed too far when the second end cap mount 160 is inserted over the second end portion 354 of the lens 120 so that the gasket maintains a minimum thickness of approximately 0.02 inch.

As further shown in FIGS. 18-21, the second end cap mount 160 includes a first engagement protrusion 560, a second engagement protrusion 562 and a third engagement protrusion 564 that extend radially outward from the distal end cap mounting portion 502. The engagement protrusions are positioned and spaced as described above for the first end cap mount 150. The distal end cap mounting portion further includes an alignment slot 566 that extends radially inward at a position on the top of the distal end cap mounting portion between the first engagement protrusion and the second engagement protrusion. In the illustrated embodiment, the alignment slot is diametrically opposite the third engagement protrusion. In the illustrated embodiment, each engagement protrusion has a triangular profile with a ramp extending distally and with a flat portion facing proximally toward the proximal lens engagement portion 500.

Figure 23:
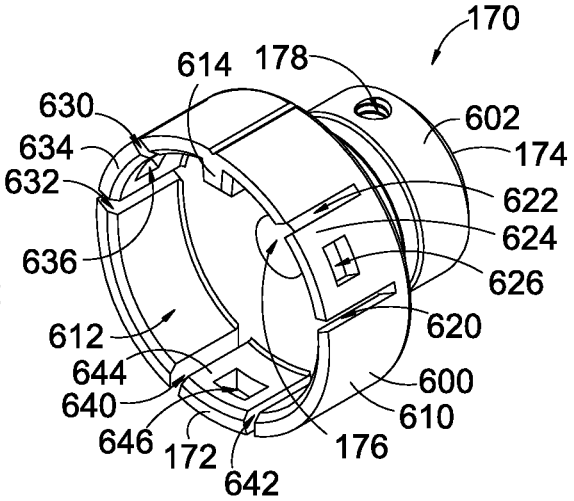
FIG. 23 illustrates a perspective view of the proximal portion of the first end cap of FIG. 22.
Figure 24:
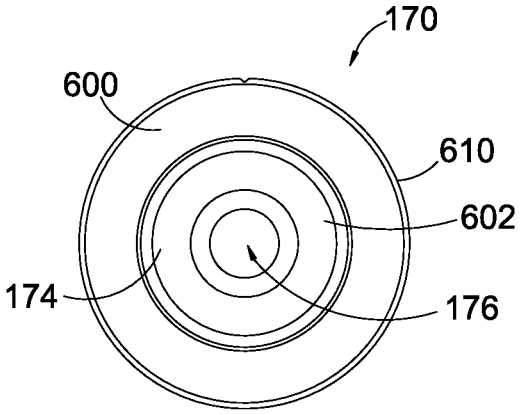
FIG. 24 illustrates an elevational view of the distal end of the first end cap of FIG. 22.
Figure 25:
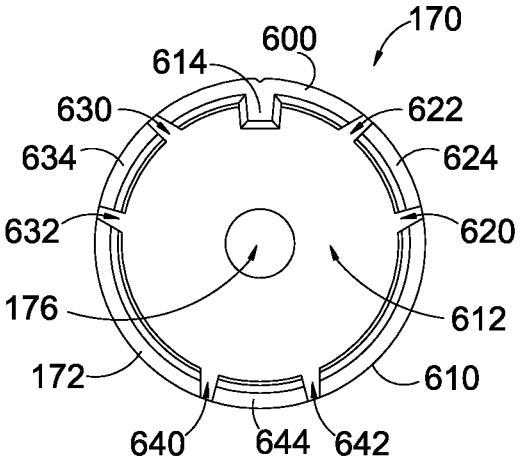
FIG. 25 illustrates an elevational view of the proximal end of the first end cap of FIG. 22.
Figure 26:
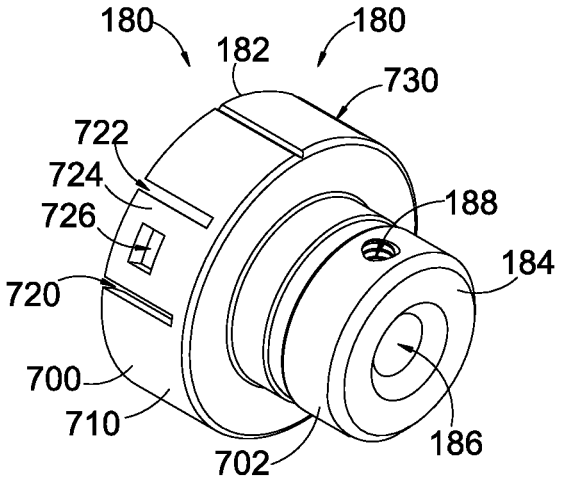
FIG. 26 illustrates a perspective view of the distal portion of the second (left) end cap of the lighting structure of FIG. 1.
Figure 27:
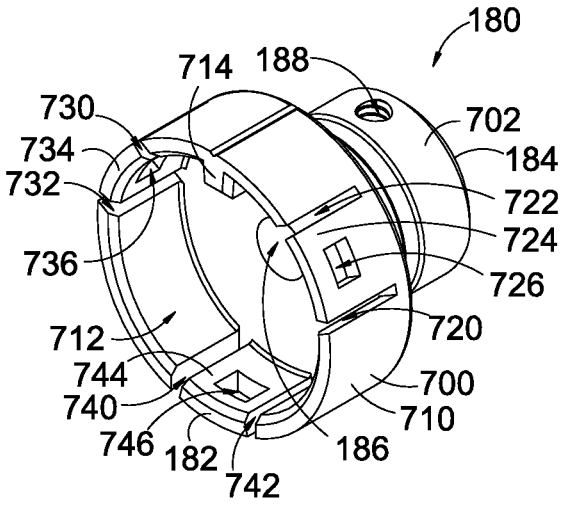
FIG. 27 illustrates a perspective view of the proximal portion of the second end cap of FIG. 26.
Figure 28:
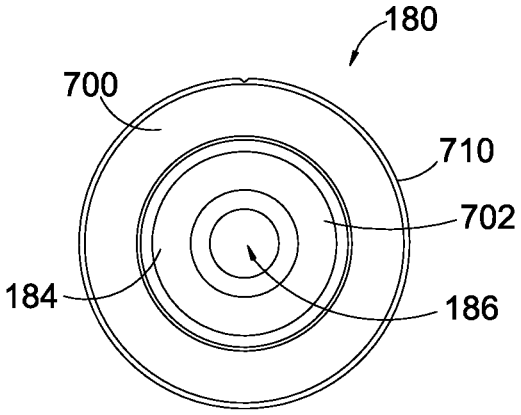
FIG. 28 illustrates an elevational view of the distal end of the second end cap of FIG. 26.
Figure 29:
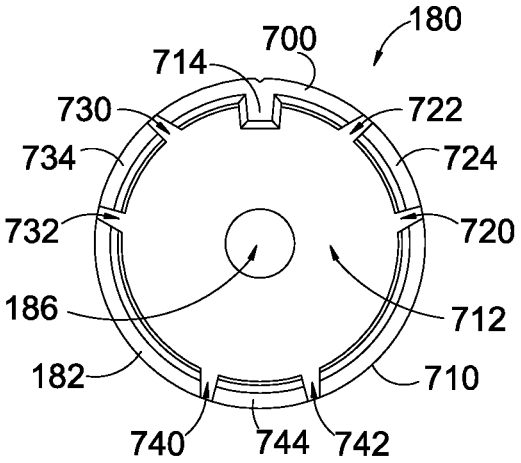
FIG. 29 illustrates an elevational view of the proximal end of the second end cap of FIG. 26.

FIGS. 23-25 illustrate the first end cap 170. The first end cap includes a proximal mounting portion 600 and a distal cable engagement portion 602. The proximal mounting portion has an outer wall 610 that surrounds a cavity 612. The cavity is shaped and sized to fit over the distal end cap mounting portion 402 of the first end cap mount 150. An upper inner portion of the outer wall includes an alignment protrusion 614 that extends radially inward into the cavity. The alignment protrusion is shaped and sized to engage the alignment slot 466 of the distal end 154 of the first end cap mount.

The outer wall 610 of the first end cap 170 has a plurality of slots formed therein. The slots extend from the proximal end 172 of the first end cap. A first slot 620 and a second slot 622 are spaced apart to form a first resilient flap 624 therebetween. A first rectangular bore 626 is formed through the first flap. A third slot 630 and a fourth slot 632 are spaced apart to form a second resilient flap 634 therebetween. A second rectangular bore 636 is formed through the second flap. A fifth slot 640 and a sixth slot 642 are spaced apart to form a third resilient flap 644 therebetween. A third rectangular bore 646 is formed through the third flap. The first rectangular bore, the second rectangular bore and the third rectangular bore are sized and positioned to engage the first engagement protrusion 460, the second engagement protrusion 462 and the third engagement protrusion 464, respectively, of the first end cap mount when the proximal mounting portion 600 of the first end cap is mounted onto the distal end cap mounting portion 402 of the first end cap mount 150. The resilient flaps move outwardly to pass over the engagement protrusions as the first end cap is positioned onto the first end cap mount.

FIGS. 23-25 illustrate the second end cap 180. The second end cap includes a proximal mounting portion 700 and a distal cable engagement portion 702. The proximal mounting portion has an outer wall 710 that surrounds a cavity 712. The cavity is shaped and sized to fit over the distal end cap mounting portion 502 of the second end cap mount 160. An upper inner portion of the outer wall includes an alignment protrusion 714 that extends radially inward into the cavity. The alignment protrusion is shaped and sized to engage the alignment slot 566 of the distal end 164 of the second end cap mount.

The outer wall 710 of the second end cap 180 has a plurality of slots formed therein. The slots extend from the proximal end 182 of the second end cap. A first slot 720 and a second slot 722 are spaced apart to form a first resilient flap 724 therebetween. A first rectangular bore 726 is formed through the first flap. A third slot 730 and a fourth slot 732 are spaced apart to form a second resilient flap 734 therebetween. A second rectangular bore 736 is formed through the second flap. A fifth slot 740 and a sixth slot 742 are spaced apart to form a third resilient flap 744 therebetween. A third rectangular bore 746 is formed through the third flap. The first rectangular bore, the second rectangular bore and the third rectangular bore are sized and positioned to engage the first engagement protrusion 560, the second engagement protrusion 562 and the third engagement protrusion 564, respectively, of the second end cap mount 160 when the proximal mounting portion 700 of the second end cap is mounted onto the distal end cap mounting portion 502 of the second end cap mount 160. The resilient flaps move outwardly to pass over the engagement protrusions as the second end cap is positioned onto the second end cap mount.

In the illustrated embodiment, the second end cap 180 is identical to the first end cap 170; however, the threaded bore 188 of the second end cap does not receive a screw and remains open. The central through bore 186 of the second end cap also remains open.

When the lighting structure 100 is assembled as illustrated herein, the lighting structure is fully sealed against external contaminants. The compression of the cable sealing-grommet 220 within the grommet-receiving recess 410 of the first end cap mount 150 seals the ribs 224 of the cable-sealing grommet against the inner surface of the grommet-receiving cavity and seals the through bore 222 of the cable-sealing grommet against the outer surface of the two-wire cable 264 of the wiring assembly 260. The first (left) end 122 of the lens 120 is sealed via the first (left) sealing gasket 200. Accordingly, no air or contaminants can flow into the cavity 126 of the lens via the first end cap mount 150.

The filter 250 seals the through bore 166 of the second end cap mount 160 as described above. The second (right) end 124 of the lens 120 is sealed via the second (right) sealing gasket 202. Accordingly, only air can flow into and out of the cavity 126 of the lens via the central through bore 186 of the second end cap 180 and the through bore of the second end cap mount. As discussed above, the filter prevents moisture and other contaminants from passing through the through bore of the second end cap mount. As the lighting structure 100 heats up during operation of the LEDs 132, the expansion of heated air within the cavity of the lens causes air to flow out of the cavity via the filter. When the lighting structure cools, air flows into the cavity via the filter.

The previous detailed description has been provided for the purposes of illustration and description. Thus, although there have been described particular embodiments of a new and useful invention, it is not intended that such references be construed as limitations upon the scope of this invention except as set forth in the following claims.

What is claimed is:

1. An end cap mounting system for a lens of a lighting fixture, the lens elongated along a longitudinal axis, the lens having an outer surface having an outer profile along the longitudinal axis, the outer profile having a first asymmetric shape, the lens having a central bore along the longitudinal axis, the central bore forming an inner surface of the lens, the inner surface of the lens having an inner profile having a second asymmetric shape, the end cap mounting system comprising:

an end cap;

an end cap mount, the end cap mount having a lens engagement portion and an end cap engagement portion, the end cap engagement portion extending distally from the lens engagement portion to engage the end cap, the lens engagement portion having a proximal end, a distal end, an outer surface and an inner surface, the inner surface defining a cavity extending distally into the lens engagement portion from the proximal end for a cavity depth to a cavity end surface, the cavity having an inner wall with a perimeter corresponding to the first asymmetric shape of the outer profile of the outer surface of the lens;

a central protrusion extending proximally from the cavity end surface towards the proximal end of the lens engagement portion, the protrusion having an outer wall with a perimeter that corresponds to the second asymmetric shape of the inner profile of the inner surface of the lens;

a first bore extending through the distal end of the lens engagement portion and through the central protrusion; and a gasket-receiving recess positioned proximate to the cavity end surface between the outer wall of the central protrusion and the inner wall of the cavity.

2. The end cap mounting system as defined in claim 1, further comprising a plurality of standoffs extending from the cavity end surface of the lens engagement portion, the standoffs positioned between the outer wall of protrusion and the inner wall of the cavity, the gasket having openings to accommodate the plurality of standoffs.

3. The end cap mounting system as defined in claim 1, wherein the end cap engagement portion of the end cap mount comprises an outer surface and a distal end surface, the outer surface supporting a plurality of first engagement features protruding from the outer surface, the end cap engagement portion further comprising a central bore that extends through the end cap engagement portion and through the protrusion within the cavity.

4. The end cap mounting system as defined in claim 3, wherein the end cap comprises a proximal portion and a distal portion, the proximal portion having an outer wall and an inner cavity, the inner cavity of the proximal portion of the end cap having an inner surface having a size selected to fit around the outer surface of the end cap engagement portion of the end cap mount, the outer wall of the proximal portion having a plurality of second engagement features, each second engagement feature positioned to engage one of the first engagement features of the end cap mount when the end cap is engaged with the end cap engagement portion of the end cap mount.

5. The end cap mounting system as defined in claim 4, wherein:

each first engagement feature of the end cap mount comprises a protrusion extending radially outward from the outer surface of the distal end portion of the lens engagement portion; and each second engagement feature of the end cap comprises an opening through the outer wall of the proximal portion of the end cap, each opening aligned with a respective protrusion when the end cap is engaged with the lens engagement portion.

6. The end cap mounting system as defined in claim 5, further comprising a plurality of pairs of slits extending through the outer wall of the proximal portion of the end cap, each pair of slits comprising a respective first slit and a respective second slit, wherein each slit extends to the proximal end of the outer wall, and wherein each second engagement feature is positioned between the respective first slit and the respective second slit in a respective pair of slits, each pair of slits enabling a respective portion of the outer wall between the respective first slit and the respective second slit in the pair to move outward away from the inner cavity of the end cap cover portion.

7. The end cap mounting system as defined in claim 3, wherein the end cap further comprises a distal portion, the distal portion having a distal end surface, the distal portion having a central bore that extends from the distal end surface to the inner cavity of the end cap.

8. The end cap mounting system as defined in claim 7, wherein the distal portion of the end cap includes an outer wall surrounding the central bore, and wherein a threaded bore extends radially inward through the outer wall to the central bore.

9. The end cap mounting system as defined in claim 8, further comprising a screw having external threads that engage the threaded bore of the end cap.

10. The end cap mounting system as defined in claim 3, further comprising a cylindrical grommet having an outer diameter and having a central bore, wherein:

the end cap engagement portion of the end cap mount includes a distal cavity; and the distal cavity has a diameter sized to receive the cylindrical grommet and to position the cylindrical grommet within the central bore such that the cylindrical grommet is aligned with the central bore of the cap cover engagement portion.

11. The end cap mounting system as defined in claim 3, further comprising a filter, the filter having an outer perimeter with a selected shape, the filter having a thickness, wherein the end cap engagement portion of the end cap mount includes a distal recess, the distal recess having the selected shape and having a recess depth corresponding to the thickness of the filter, the filter positioned in the recess.

12. The end cap mounting system as defined in claim 11, wherein the filter comprises a microporous polytetrafluoroethylene (PTFE) membrane.

13. The end cap mounting system as defined in claim 1, further comprising a gasket, the gasket having a shape configured to fit into the gasket-receiving recess of the lens engagement portion.

14. The end cap mounting system as defined in claim 13, wherein the gasket comprises a high viscosity adhesive that fills the gasket-receiving recess.

15. The end cap mounting system as defined in claim 14, wherein the gasket comprises silicone rubber.

16. A lighting system comprising:

a lens holder having a longitudinally extending support surface, a first side wall extending from the support surface and a second side wall extending from the support surface, each side wall having a respective lens retention feature;

a longitudinally extending lens positionable within the lens holder, the lens having a first end and a second end, the lens having a first retention feature to engage the lens retention feature of the first side wall and a second retention feature to engage the lens retention feature of the second side wall, the lens further including a printed circuit board receiving recess;

a printed circuit board comprising a plurality of light-emitting diodes (LEDs), the printed circuit board positioned in the printed circuit board receiving recess of the lens;

a first end cap mounting assembly positioned on the first end of the lens, the first end cap mounting assembly comprising:

a first lens cap mount, the first end cap mount comprising:

a first lens engagement portion having a first cavity surrounded by a first cavity wall, the first lens engagement portion receiving a portion of the first end of the lens within the first cavity, the first lens engagement portion including a first lens engagement portion central bore extending into the first cavity;

a grommet positioned within the first lens engagement portion central bore, the grommet having a grommet central bore; and a first end cap engagement portion extending from the first lens engagement portion;

and a first end cap positioned over a distal end of the first end cap engagement portion of the first end cap mount, the first end cap having a first end cap central bore aligned with the first lens engagement portion central bore;

a second end cap mounting assembly positioned on the second end of the lens, the second end cap mounting assembly comprising:

a second end cap mount, the second end cap mount comprising:

a second lens engagement portion having a second cavity surrounded by a second cavity wall, the second lens engagement portion receiving a portion of the second end of the lens within the second cavity, the second lens engagement portion including a second lens engagement portion central bore extending into the second cavity;

a filter positioned over the second lens engagement portion central bore; and a second end cap engagement portion extending from the second lens engagement portion;

and a second end cap positioned over the second end cap engagement portion of the second end cap mount, the second end cap having a second end cap central bore aligned with the central bore of the first end cap mount;

and an electrical cable positioned through the first end cap central bore, through the grommet central bore and through the first lens engagement portion central bore, the electrical cable having at least first and second conductors engaged with the printed circuit board wherein the lens has an outer surface having an outer asymmetric profile and has an inner surface having an inner asymmetric profile;

the first cavity of the first lens engagement portion has an inner surface with an inner profile matching the outer asymmetric profile of the lens;

a first protrusion extends proximally within the first cavity, the first protrusion having an outer surface with an outer profile matching the inner asymmetric profile of the lens.

17. The lighting system as defined in claim 16, wherein the first end cap and the second end cap are identical.

18. The lighting system as defined in claim 16, further comprising:

a first gasket within the first cavity of the first lens engagement portion, the first gasket positioned against the first end of the lens; and a second gasket within the second cavity of the second lens engagement portion, the second gasket positioned against the second end of the lens.

19. The lighting system as defined in claim 16, wherein:

a portion of the first cavity wall of the first lens engagement portion has a first peripheral opening positioned to enable light from a portion of the first end portion of the lens to pass through the first peripheral opening; and a portion of the second cavity wall of the second lens engagement portion has a second peripheral opening positioned to enable light from a portion of the second end portion of the lens to pass through the second peripheral opening.

20. The lighting system as defined in claim 16, wherein:

the second cavity of the second lens engagement portion has an inner surface with an inner profile matching the outer asymmetric profile of the lens;

a second protrusion extends proximally within the second cavity, the second protrusion having an outer surface with an outer profile matching the inner asymmetric profile of the lens; and when viewed from the respective proximal ends of the first lens engagement portion and the second lens engagement portion, the inner profile of the first cavity and the inner profile of the second cavity are mirror images of each other, and the outer profile of the first protrusion and the outer profile of the second protrusion are mirror images of each other.

* * * * *